US011207557B2

(12) United States Patent
Chen

(10) Patent No.: US 11,207,557 B2
(45) Date of Patent: Dec. 28, 2021

(54) DUMBBELL AND BARBELL SUPPORTING SYSTEM

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 59 days.

(21) Appl. No.: 16/683,307

(22) Filed: Nov. 14, 2019

(65) Prior Publication Data

US 2021/0146187 A1 May 20, 2021

(51) Int. Cl.
*A63B 21/078* (2006.01)
*A63B 21/072* (2006.01)

(52) U.S. Cl.
CPC ..... *A63B 21/0783* (2015.10); *A63B 21/078* (2013.01); *A63B 21/0724* (2013.01); *A63B 21/0726* (2013.01); *A63B 21/0728* (2013.01)

(58) Field of Classification Search
CPC ..... A63B 21/0724; A63B 21/0726; A63B 21/0728; A63B 21/0783; A63B 21/00047; A63B 21/072; A63B 21/0722; A63B 21/078; A63B 2225/10
See application file for complete search history.

(56) References Cited

U.S. PATENT DOCUMENTS

| | | | | |
|---|---|---|---|---|
| 6,592,499 | B2 * | 7/2003 | Parker | A63B 21/072 482/106 |
| 7,001,314 | B1 * | 2/2006 | Hummer, Jr. | A63B 21/00181 482/104 |
| 7,022,053 | B2 | 4/2006 | Whetstone | |
| 7,094,185 | B2 * | 8/2006 | Greenland | A63B 21/06 482/100 |
| 7,201,711 | B2 | 4/2007 | Towley, III et al. | |
| 7,491,156 | B1 | 2/2009 | GaoYong | |
| 8,047,971 | B2 | 11/2011 | Parker | |
| 8,444,537 | B1 | 5/2013 | Santoro | |
| 8,992,395 | B2 | 3/2015 | Orakwusi | |
| 9,717,943 | B2 | 8/2017 | Klonoski | |
| 9,956,451 | B1 | 5/2018 | Wang | |
| 10,328,299 | B2 | 6/2019 | Wang | |
| 10,843,028 | B2 * | 11/2020 | Nalley | A63B 21/0604 |
| 2005/0054494 | A1 * | 3/2005 | Guerrettaz | A63B 71/0036 482/97 |

(Continued)

*Primary Examiner* — Megan Anderson
(74) *Attorney, Agent, or Firm* — Browdy and Neimark, PLLC

(57) ABSTRACT

A dumbbell and barbell supporting system includes two tables rotatably attached to a base and rotatable relative to the base to two working positions where the tables are inclined relative to each other or are in line with each other, and two dumbbells disposed on the tables, the dumbbells each include two or more weight members or two weight elements, and a handlebar engageable with the weight members and the weight elements for detachably coupling the weight members and the weight elements to the handlebar, the tables are rotatable to be in lined with each other, and a longitudinal bar engageable with the weight members and the weight elements for forming a barbell exerciser device.

8 Claims, 9 Drawing Sheets

(56) References Cited

U.S. PATENT DOCUMENTS

| | | | | |
|---|---|---|---|---|
| 2009/0305851 | A1* | 12/2009 | Sukup | A63B 21/078<br>482/104 |
| 2018/0178051 | A1* | 6/2018 | Shaw, Jr. | A63B 21/4029 |
| 2020/0346063 | A1* | 11/2020 | Shaw, Jr. | A63B 23/12 |

* cited by examiner

DUMBBELL AND BARBELL SUPPORTING SYSTEM

BACKGROUND OF THE INVENTION

1. Field of the Invention

The present invention relates to an exercise device supporting system, and more particularly to a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

2. Description of the Prior Art

Various kinds of typical adjustable exercise devices, such as dumbbells have been developed and provided for conducting various exercise operations, and various kinds of typical supporting devices have been developed and provided for supporting various exercise devices, such as the adjustable dumbbells, the barbell devices or the like.

For example, U.S. Pat. No. 7,022,053 B2 to Whetstone, U.S. Pat. No. 7,201,711 B2 to Towley, III et al., U.S. Pat. No. 7,491,156 to GaoYong, U.S. Pat. No. 8,047,971 B2 to Parker, U.S. Pat. No. 8,444,537 B1 to Santoro, U.S. Pat. No. 8,992,395 to Orakwusi, U.S. Pat. No. 9,717,943 B2 to Klonoski, U.S. Pat. No. 9,956,451 B1 to Wang, and U.S. Pat. No. 10,328,299 B2 to Wang disclose several of the typical exercise device supporting structures or configurations for supporting adjustable dumbbell devices or the like.

However, the typical exercise device supporting structures or configurations may only be provided for supporting the dumbbell devices, but failed to teach and provide an exercise device supporting system for supporting one or more dumbbell devices and for allowing the dumbbell devices to be easily and quickly adjusted or converted to a barbell device.

The present invention has arisen to mitigate and/or obviate the afore-described disadvantages of the conventional exercise device supporting structures.

SUMMARY OF THE INVENTION

The primary objective of the present invention is to provide a dumbbell and barbell supporting system including an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

In accordance with one aspect of the invention, there is provided a dumbbell and barbell supporting system comprising a base, a first table and a second table rotatably attached to the base, the first and the second tables being rotatable relative to the base to a first working position where the first and the second tables are inclined relative to each other, and a second working position where the first and the second tables are in line with each other, a first dumbbell disposed on the first table, the first dumbbell including a first weight member and a second weight member, and a first handlebar engageable with the first weight member and the second weight member for detachably coupling the first weight member and the second weight member to the first handlebar, a second dumbbell disposed on the second table, the second dumbbell including a first weight element and a second weight element, and a second handlebar engageable with the first weight element and the second weight element for detachably coupling the first weight element and the second weight element to the second handlebar, the first weight member being movable toward or disposed beside the second weight member, and the first weight element being movable toward or disposed beside the second weight element when the first and the second tables are positioned in the second working position, and a longitudinal bar engageable with the first weight member and the first weight element for detachably coupling the first weight member and the second weight member and the first weight element and the second weight element to the longitudinal bar and for allowing the first dumbbell and the second dumbbell to be detachably attached or coupled to the longitudinal bar for being acted or operated as a barbell exerciser device selectively.

The base includes two posts extended upwardly from the base, and the first and the second tables each include a pivot spindle pivotally or rotatably engaged with the posts of the base for allowing the first and the second tables to be pivoted or rotated relative to the base between the first working position and the second working position.

The first and the second tables each include a spring biased latch engageable with the post for anchoring the first and the second tables to the base either at the first working position or at the second working position selectively. The base includes two ears mounted on the posts respectively, and the ears each include two orifices formed in the ears for engaging with the spring biased latch and for anchoring or retaining or positioning the tables to the base either at the first or inclined working position or at the second or aligned working position.

The first table includes two casings supported on the first table for engaging with the first and the second dumbbell members and for supporting the first and the second dumbbell members on the first table separately, and the second table includes two casings supported on the second table for engaging with the first and the second dumbbell elements and for supporting the first and the second dumbbell elements on the second table separately.

The first dumbbell includes one or more, such as two spring biased catches slidably engaged in the first handlebar and engageable with the first and the second weight members for detachably coupling the first and the second weight members to the first handlebar.

The first and the second weight members each include a dovetail slot formed in one side, and a dovetail on another side, and the first handlebar includes two end plates, and each of the end plates include a dovetail slot formed therein for engaging with the dovetails of the first and the second weight members and for detachably coupling the first and the second weight members together.

The second dumbbell includes one or more, such as two spring biased catches slidably engaged in the second handlebar and engageable with the first and the second weight elements for detachably coupling the first and the second weight elements to the second handlebar.

The first and the second weight elements each include a dovetail slot formed in one side, and a dovetail on another side, and the second handlebar includes two end plates, and each end plate include a dovetail slot for engaging with the dovetails of the first and the second weight elements and for detachably coupling the first and the second weight elements together.

The longitudinal bar includes two end panels, and each of the end panels include a dovetail slot for engaging with the dovetails of the first weight member and the first weight element. The longitudinal bar includes two spring biased locks for engaging with the first and the second weight members and the first and the second weight elements and for detachably anchoring or coupling the first and the second weight members and the first and the second weight elements to the longitudinal bar.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 9:
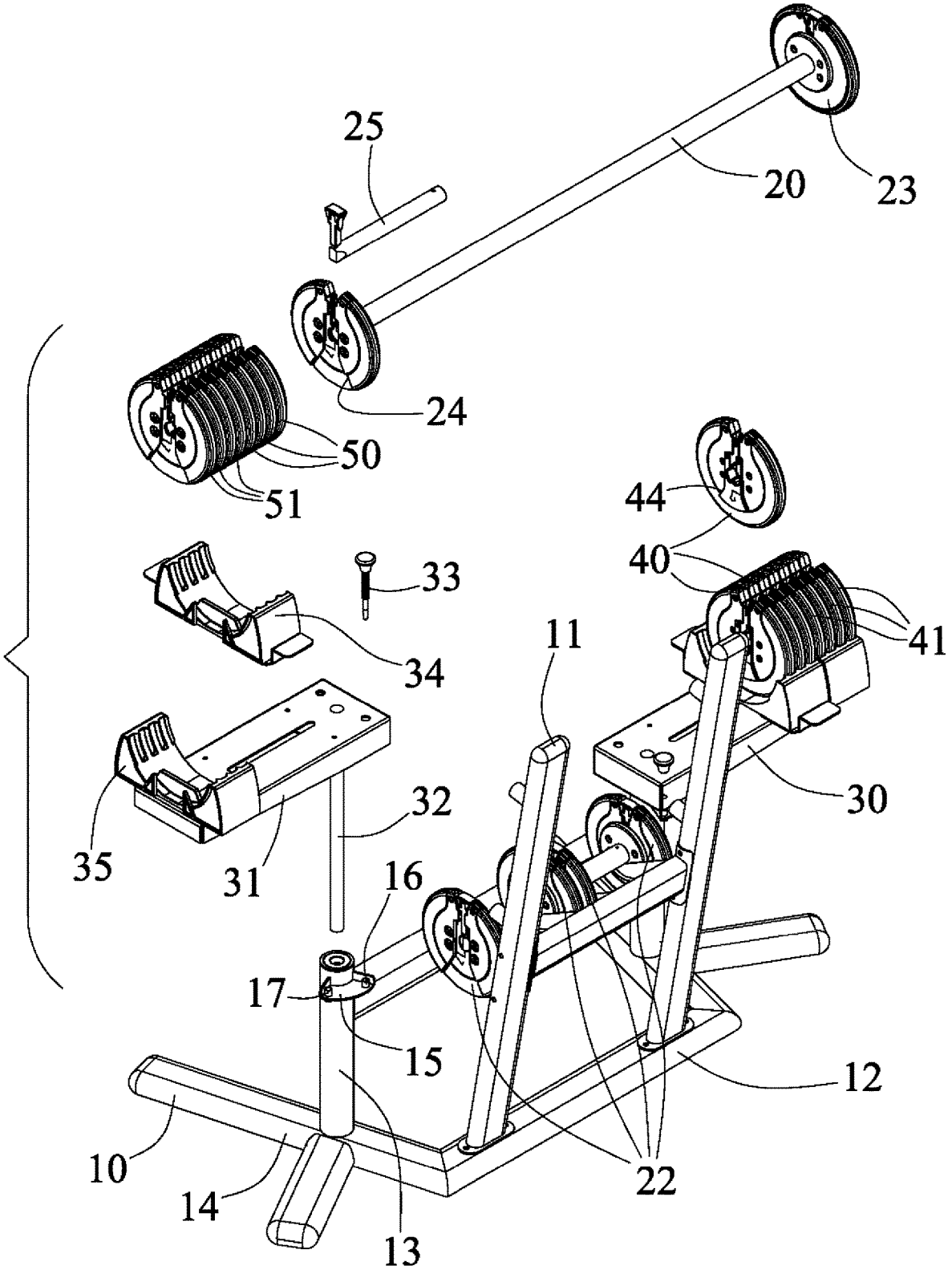
FIGS. 9 and 10 are further partial exploded views of the dumbbell and barbell supporting system.
Figure 10:
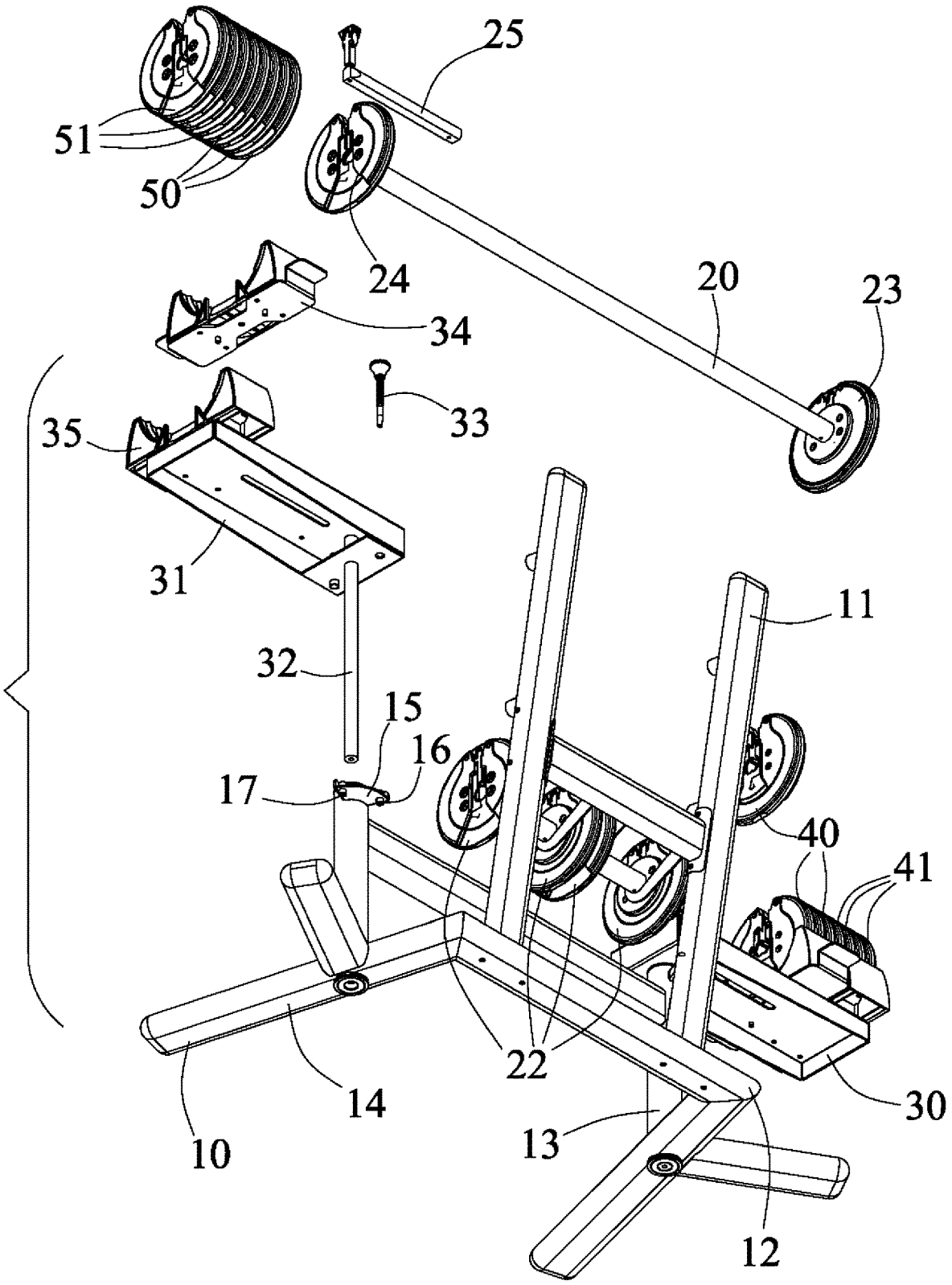

Referring to the drawings, and initially to FIGS. 1-6, a dumbbell and barbell supporting system in accordance with the present invention comprises a supporting base 10, a bracket or frame or stand 11 extended upwardly from the base 10, such as extended upwardly from the rear portion 12 of the base 10 for supporting one or more elongated or longitudinal bars 20, 21 (FIGS. 1, 2 and 4) and/or one or more weight rings or plates or elements or weight members 22 (FIGS. 2 and 9-10) thereon. The base 10 may further include one or more (such as two) columns or posts 13 extended upwardly therefrom, such as extended upwardly from the middle or intermediate portion 14 of the base 10, and two guide plates or ears 15 (FIGS. 5-10) attached or mounted or secured to or formed or provided on the posts 13 respectively, and the ears 15 each include one or more (such as two) holes or orifices 16, 17 formed therein.

One or more (such as two) supporting plates or tables 30, 31 are pivotally or rotatably attached or mounted or secured to the base 10, for example, the first and the second tables 30, 31 each include a pivot axle or shaft or spindle 32 extended downwardly therefrom and engaged with the posts 13 of the base 10 respectively for allowing the tables 30, 31 to be pivoted or rotated relative to the base 10 with the spindle 32 between a first or tilted or inclined or angled working position (FIGS. 1, 3-4 and 7) where the tables 30, 31 are tilted or inclined or angled relative to each other, and a second or aligned working position (FIGS. 2 and 8) where the tables 30, 31 are in line or aligned with each other. The tables 30, 31 each include a spring biased catch or latch 33 attached thereto and engageable with either of the posts 13 or of the orifices 16, 17 of the respective ear 15 of the base 10 for anchoring or retaining or positioning the tables 30, 31 to the base 10 at the first or inclined or angled working position or at the second or aligned working position.

Two dumbbell exercise devices, such as a first and a second adjustable dumbbells 4, 5 are detachably or changeably or removably provided or disposed or supported on the tables 30, 31 respectively, and two brackets or casings 34, 35 may further be provided and attached or mounted or secured on the respective table 30, 31 for engaging with and for supporting the first and the second dumbbells 4, 5 on the tables 30, 31 respectively. For example, the first dumbbell 4 includes two sets of weight rings or plates or members 40, 41, and the second dumbbell 5 includes two sets of weight rings or plates or elements 50, 51, and the dumbbells 4, 5 each include a first or a second handlebar 42, 52 to be disposed or engaged between or with the weight members 40, 41 and the weight elements 50, 51 for forming or acting as the dumbbells 4, 5. The above-described structure or configuration for the dumbbells 4, 5 is typical and will not be described in specific details. The casings 34, 35 are provided for engaging with and for supporting the sets of weight members 40, 41 and the weight elements 50, 51 of the dumbbells 4, 5 respectively.

The casings 34, 35 may be firmly or solidly and stably attached or mounted or secured on the tables 30, 31 with welders or adhesive materials or the like, or with screws or bolts or catches or latches or fasteners (not illustrated) or the like, or may be slidably or detachably or changeably or removably and/or adjustably attached or mounted or secured to the tables 30, 31 for suitably supporting the sets of weight members 40, 41 and the weight elements 50, 51 of the dumbbells 4, 5 on the tables 30, 31 respectively. In operation, as shown in FIGS. 1, 3-4 and 7, the dumbbells 4, 5 are disposed or supported on the tables 30, 31 which are tilted or inclined relative to each other and arranged for allowing the handlebars 42, 52 of the dumbbells 4, 5 to be easily and quickly held or grasped and actuated or operated by the users selectively.

Figure 1:
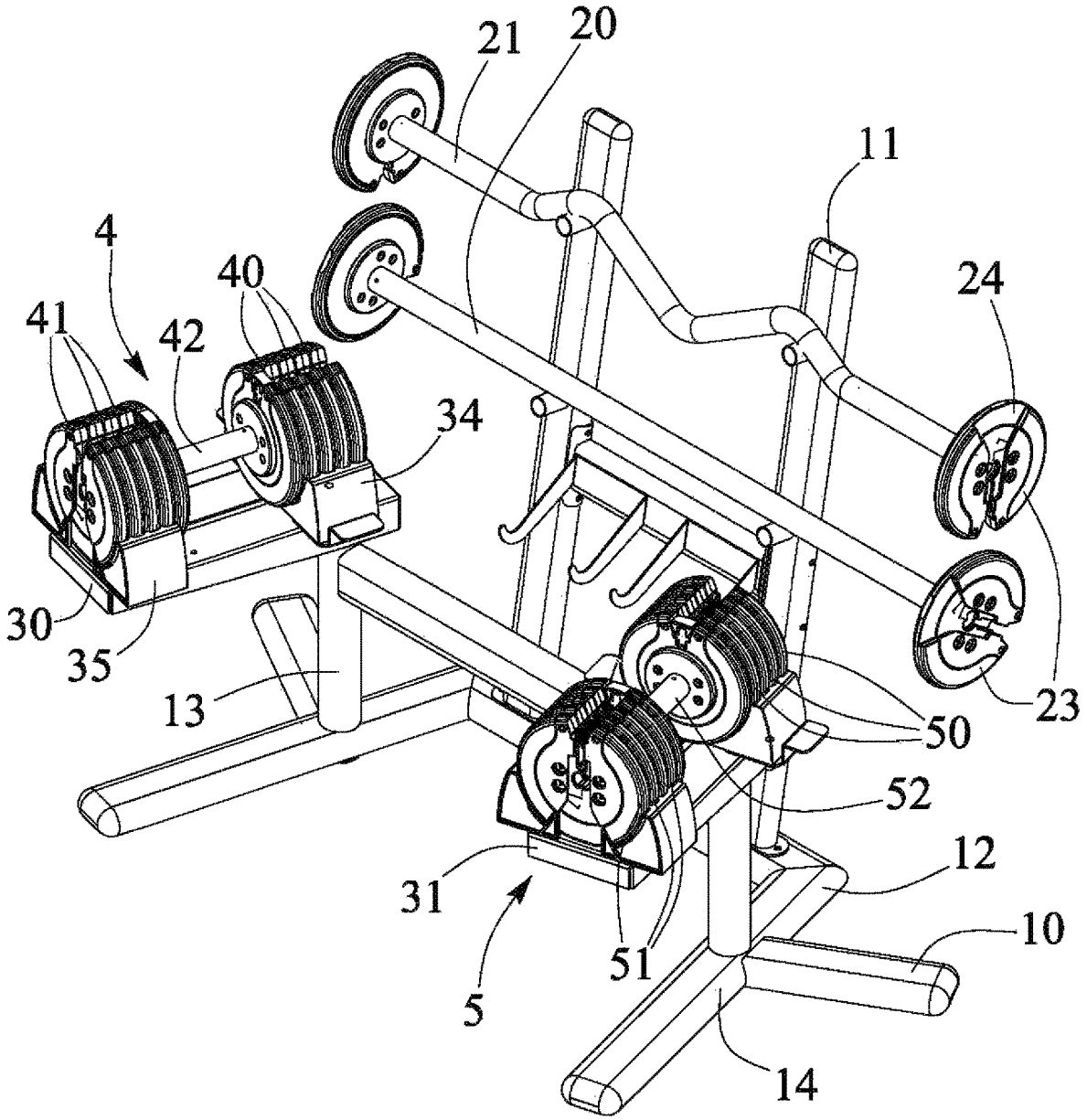
FIG. 1 is an upper perspective view of a dumbbell and barbell supporting system in accordance with the present invention as seen from the front portion of the dumbbell and barbell supporting system.
Figure 2:
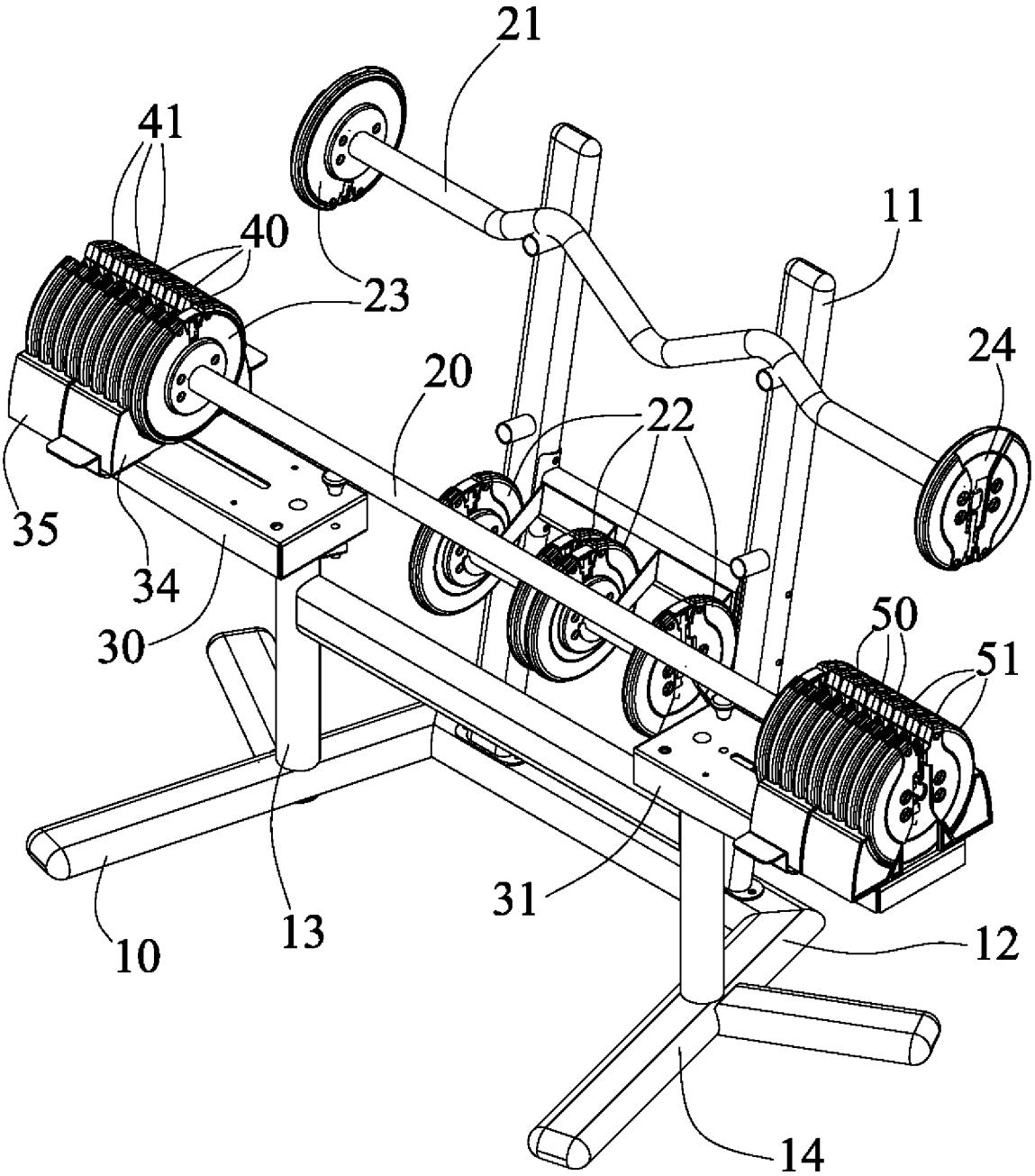
FIG. 2 is another upper perspective view similar to FIG. 1, illustrating the operation of the dumbbell and barbell supporting system.
Figure 3:
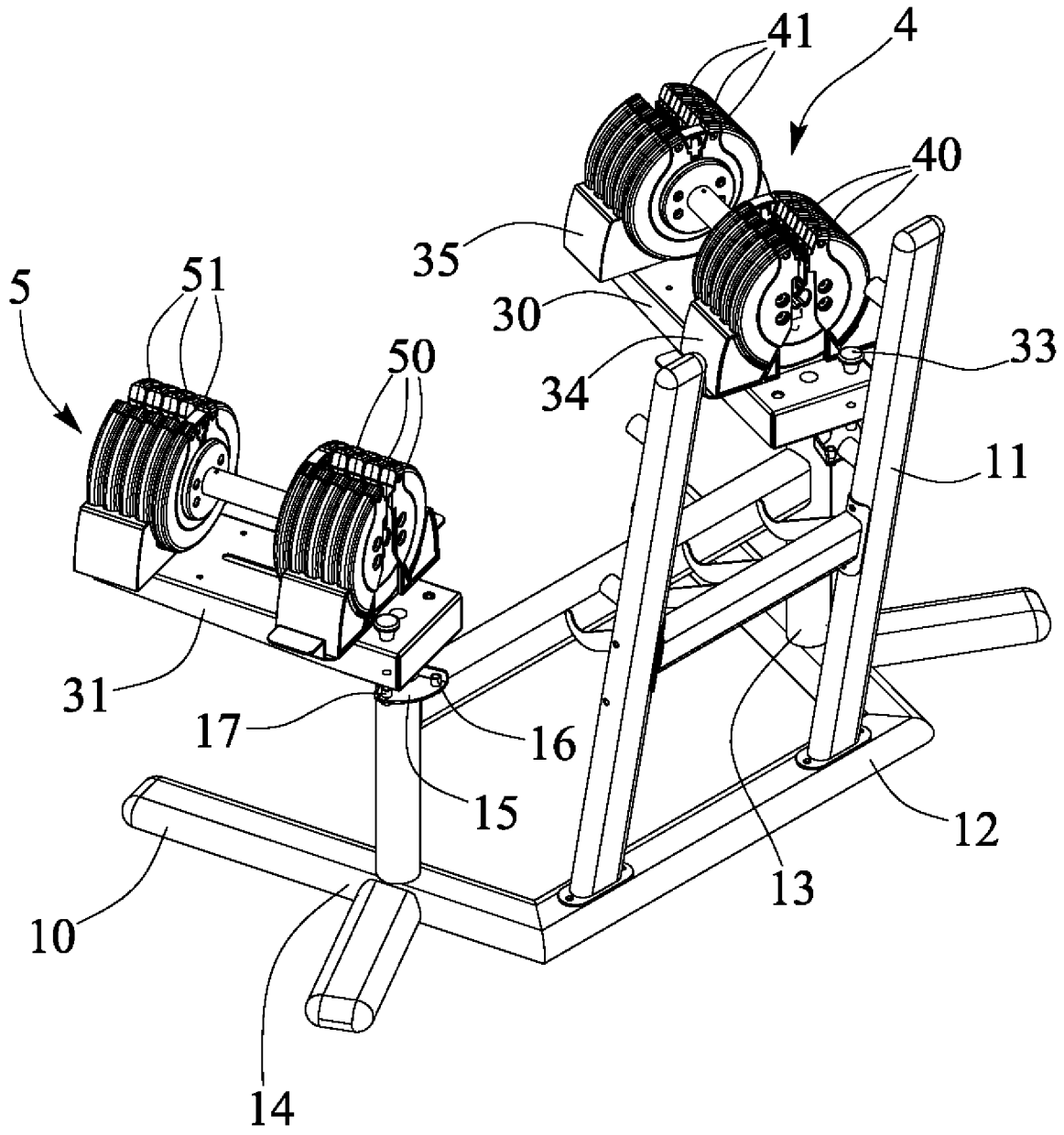
FIG. 3 is a further upper perspective view of the dumbbell and barbell supporting system as seen from the rear portion of the dumbbell and barbell supporting system.
Figure 4:
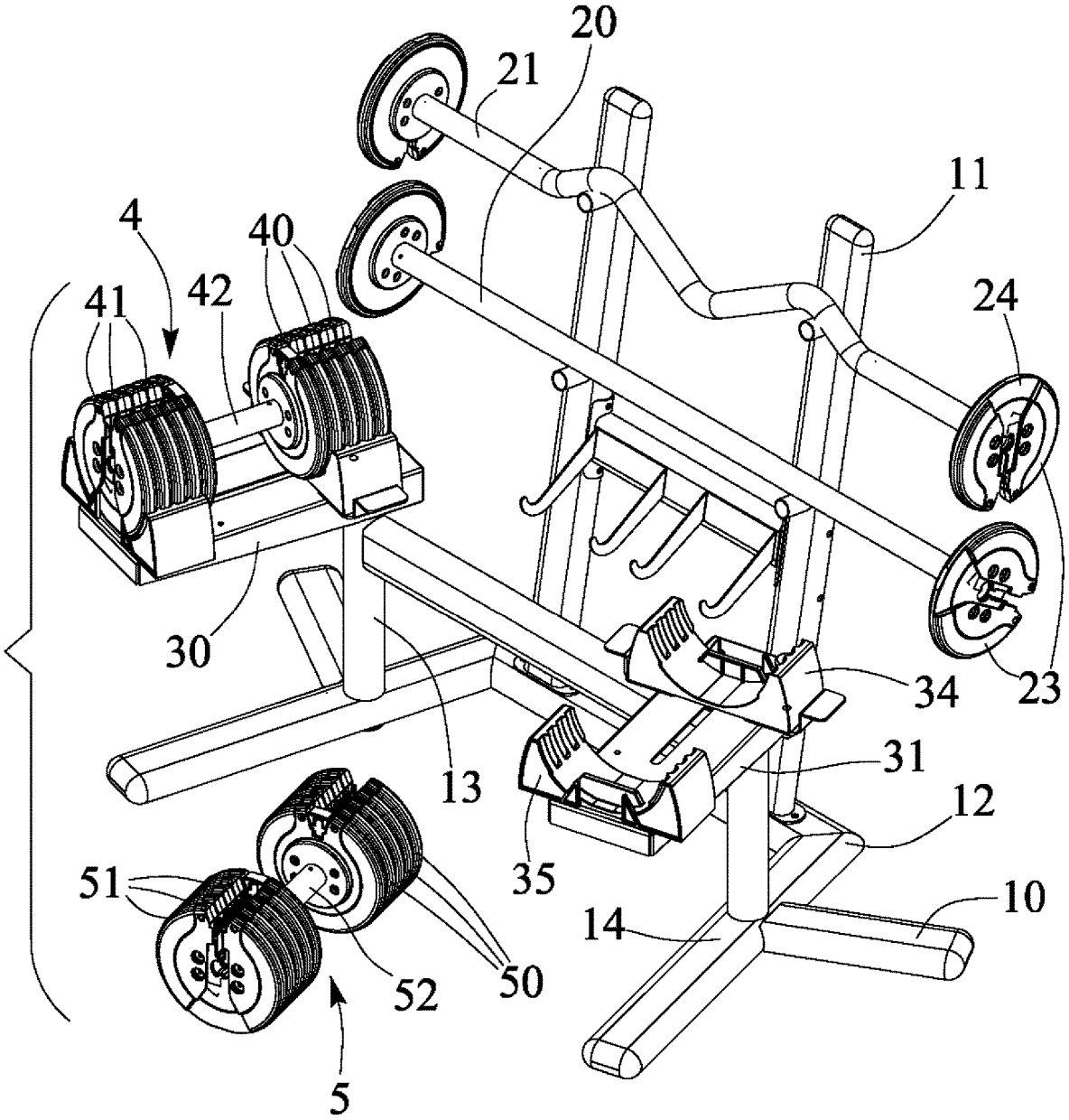
FIG. 4 is a partial exploded view of the dumbbell and barbell supporting system.
Figure 5:
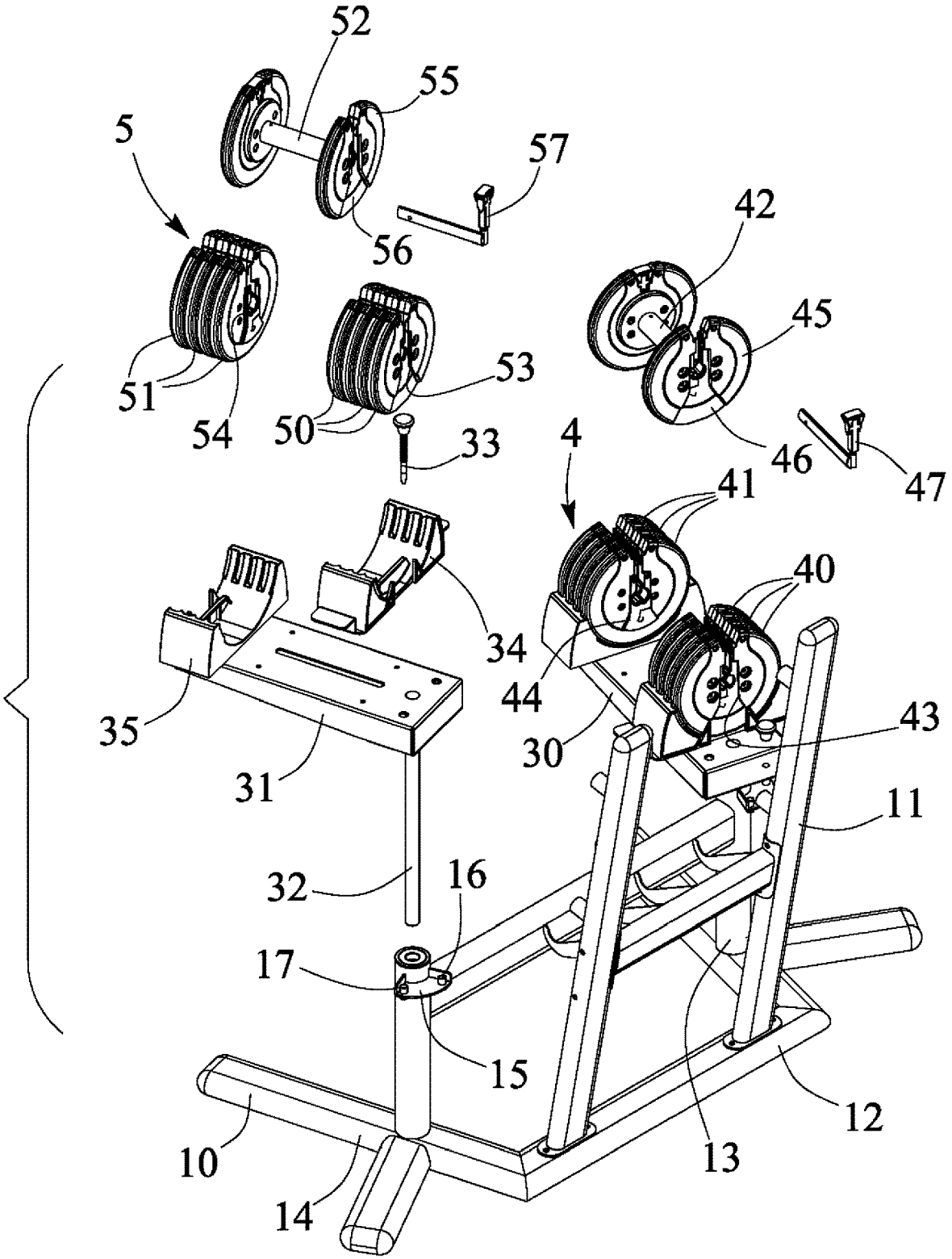
FIGS. 5 and 6 are other partial exploded views of the dumbbell and barbell supporting system.
Figure 6:
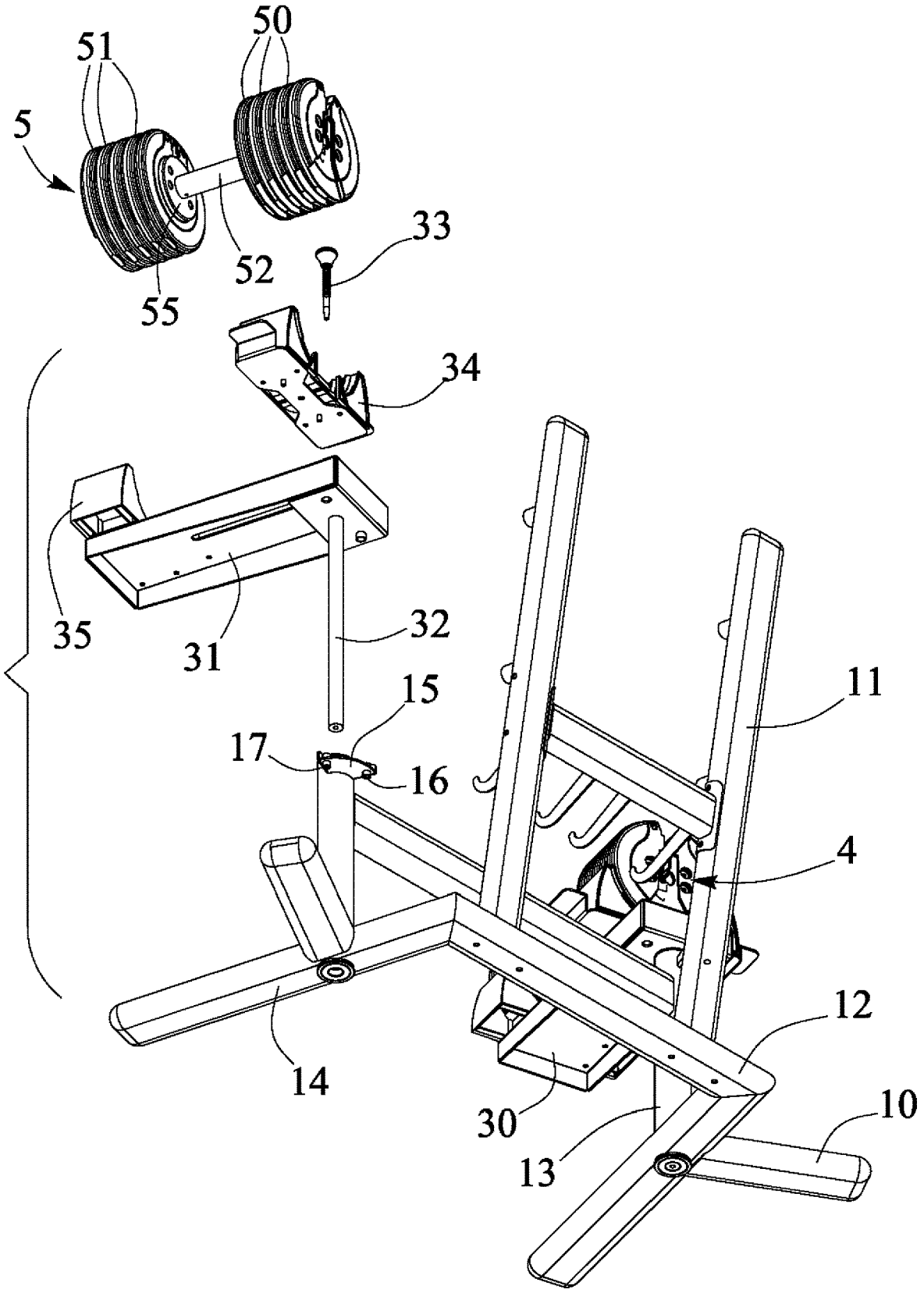
Figure 7:
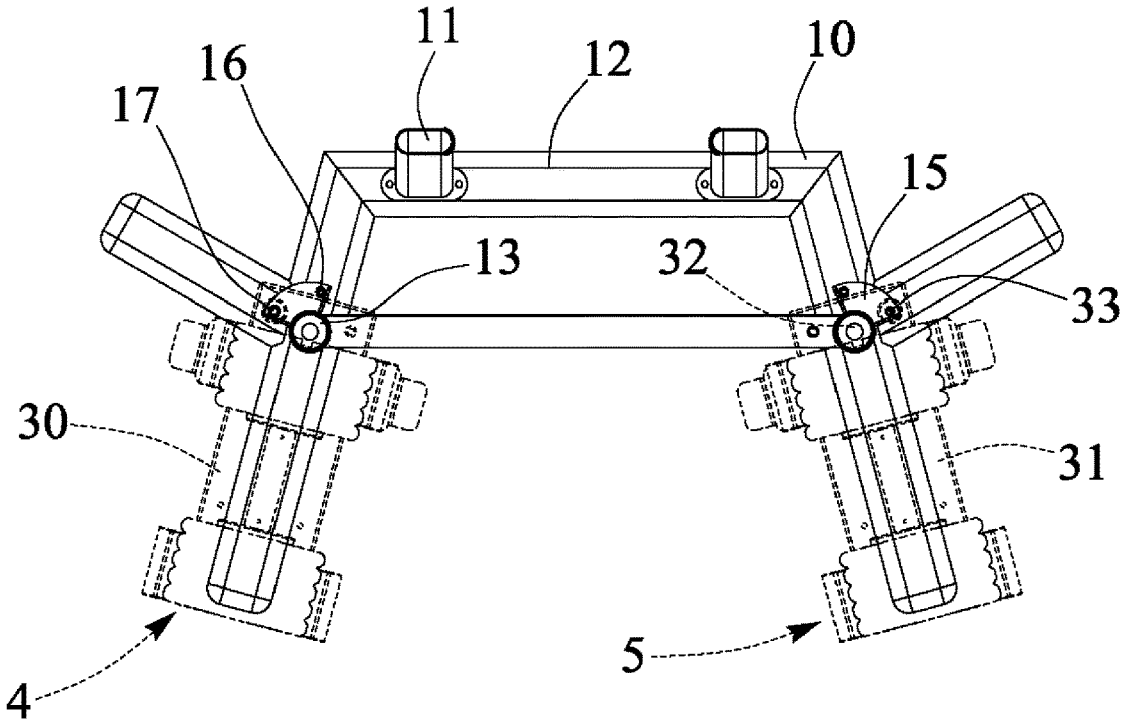
FIG. 7 is a top plan schematic view of the dumbbell and barbell supporting system.

It is preferable that one of the casings 34 is detachable or removable from the table 30, 31 (FIGS. 5, 6) and movable or adjustable toward the other casing 35 (FIG. 2) selectively, and for allowing the sets of weight members 40, 41 and the weight elements 50, 51 of the dumbbells 4, 5 to be disposed or supported adjacent or beside each other, best shown in FIG. 2 when required. As shown in FIG. 4, the first set of the weight members 40 or the first weight members 40 and the second set of the weight members 41 or the second weight members 41 each include a dovetail slot 43 formed in one side portion thereof and a dovetail 44 on the other side portion thereof for engaging with the dovetail slot 43 of the other weight members 40, 41 and for allowing the weight members 40, 41 to be engaged with each other in order to form the first set of the weight members 40 and the second set of the weight members 41 respectively. The dovetails 44 of the two sets of the weight members 40, 41 are disposed and located or faced or directed toward each other.

Similarly, the first set of the weight elements 50 or the first weight elements 50 and the second set of the weight elements 51 or the second weight elements 51 each include a dovetail slot 53 formed in one side portion thereof and a dovetail 54 on the other side portion thereof for engaging with the dovetail slot 53 of the other weight elements 50, 51 and for allowing the weight elements 50, 51 to be engaged with each other in order to form the first set of the weight elements 50 and the second set of the weight elements 51 respectively, and the dovetails 54 of the two sets of the weight elements 50, 51 are disposed and located or faced or directed toward each other. The handlebars 42, 52 of the dumbbells 4, 5 each include two end plates 45, 55, and each end plate 45, 55 include another dovetail slot 46, 56 formed therein for engaging with the dovetails 44, 54 of the weight members 40, 41 and the weight elements 50, 51 respectively, and for allowing the weight members 40, 41 and the weight elements 50, 51 to be attached or coupled to the handlebars 42, 52 respectively.

The dumbbells 4, 5 each further include one or more (such as two) spring biased latch or catch 47, 57 slidably received or engaged in the handlebars 42, 52 respectively and engageable with the weight members 40, 41 and the weight elements 50, 51 for allowing the selective number of the weight members 40, 41 and the weight elements 50, 51 to be attached or coupled to the handlebars 42, 52 respectively. It is to be noted that the dovetails 44 of the two sets of the weight members 40, 41 are normally disposed and directed toward each other, and the dovetails 54 of the two sets of the weight elements 50, 51 are also disposed and directed toward each other for allowing the dovetail slots 46, 56 of the end plates 45, 55 of the handlebars 42, 52 to be engaged with the dovetails 44, 54 of the weight members 40, 41 and the weight elements 50, 51 selectively.

When it is required to be acted or operated as a barbell exerciser, as shown in FIGS. 2 and 8-10, the tables 30, 31 may be pivoted or rotated relative to the base 10 to a position where the tables 30, 31 are aligned with each other. The first set of the weight members 40 or the first weight members 40 and the first set of the weight elements 50 or the first weight elements 50 are first pivoted or rotated relative to the tables 30, 31 and the second set of the weight members 41 or the second weight members 41 and the second set of the weight elements 51 or the second weight elements 51 for allowing the first weight members 40 and the second weight members 41 to be disposed beside each other and engaged with each other, and also for allowing the first weight elements 50 and the second weight elements 51 to be disposed beside each other and engaged with each other.

The longitudinal bars 20, 21 each also include two end plates or panels 23, and each end panel 23 include another dovetail slot 24 formed therein for engaging with the dovetails 44, 54 of the weight members 40 and the weight elements 50 respectively, and for allowing the weight members 40, 41 and the weight elements 50, 51 to be attached or coupled to the longitudinal bars 20, 21 respectively. The weight members 40, 41 and the weight elements 50, 51 may also be attached or coupled to the longitudinal bars 20, 21 with spring biased latches or catches or locks 25 (FIGS. 9, 10) which may attached or coupled the selective number of the weight members 40, 41 and the weight elements 50, 51 to the longitudinal bars 20, 21 respectively.

Figure 8:
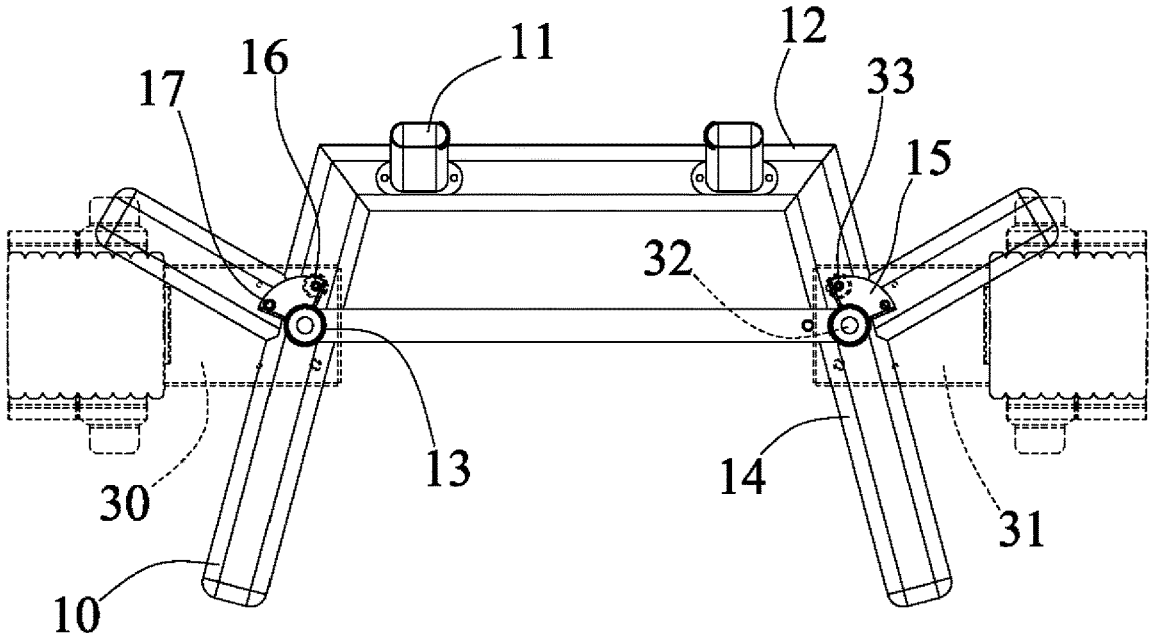
FIG. 8 is another top plan schematic view similar to FIG. 7, illustrating the operation of the dumbbell and barbell supporting system.

In operation, as shown in FIGS. 1, 3-4 and 7, the dumbbells 4, 5 and the tables 30, 31 are tilted or inclined relative to each other and arranged for allowing the handlebars 42, 52 of the dumbbells 4, 5 to be easily and quickly held or grasped and actuated or operated by the users selectively in order to operate or conduct a dumbbell exercising operation. Alternatively, as shown in FIGS. 2 and 8, the tables 30, 31 may also be pivoted or rotated relative to the base 10 to a position where the tables 30, 31 are in line or aligned with each other, the first weight members 40 and the first weight elements 50 should then be pivoted or rotated relative to the tables 30, 31 and the second weight members 41 and the second weight elements 51 and then disposed and supported beside the second weight members 41 and the second weight elements 51 respectively, the end panels 23 of the longitudinal bars 20, 21 may then be engaged with the dovetails 44, 54 of the weight members 40 and the weight elements 50 for allowing the weight members 40, 41 and the weight elements 50, 51 to be attached or coupled to the longitudinal bars 20, 21 respectively.

Accordingly, the dumbbell and barbell supporting system in accordance with the present invention includes an adjustable structure or configuration for supporting one or more dumbbell devices and for allowing the weight plates or weight members of the dumbbell devices to be attached or mounted to a bar for acting as a barbell device and arranged for allowing the dumbbell devices and the barbell device to be easily and quickly adjusted or converted to each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dumbbell and barbell supporting system comprising:

a base, a first table and a second table rotatably attached to said base, said first and said second tables being rotatable relative to said base to a first working position where said first and said second tables are angled relative to each other, and a second working position where said first and said second tables are in line with each other, a first dumbbell disposed on said first table, said first dumbbell including a first weight member and a second weight member, said first and said second weight members each including a dovetail slot formed in one side, and a dovetail on another side, and a first handlebar including two end plates, and each of said two end plates including a dovetail slot for engaging with said dovetails of said first weight member and said second weight member and for detachably coupling said first weight member and said second weight member to said first handlebar, a second dumbbell disposed on said second table, said second dumbbell including a first weight element and a second weight element, said first and said second weight elements each including a dovetail slot formed in one side, and a dovetail on another side, and a second handlebar including two end plates, and each of said two end plates including a dovetail slot for engaging with said dovetails of said first weight element and said second weight element for detachably coupling said first weight element and said second weight element to said second handlebar, said first weight member being disposed beside said second weight member, and said first weight element being disposed beside said second weight element when said first and said second tables are positioned in said second working position, and a longitudinal bar engageable with said first weight member and said second weight member and said first weight element and said second weight element for detachably coupling said first weight member and said second weight member and said first weight element and said second weight element to said longitudinal bar, said longitudinal bar including two end panels, and each of said two end panels including a dovetail slot for engaging respectively with said dovetails of said first weight member and said first weight element and with said dovetails of said second weight member and said second weight element.

2. The dumbbell and barbell supporting system as claimed in claim 1, wherein said base includes two posts extended upwardly from said base, and said first and said second tables each include a pivot spindle, and said pivot spindles of said first and said second tables are engaged with said two posts of said base respectively for allowing said first and said second tables to be rotated relative to said base.

3. The dumbbell and barbell supporting system as claimed in claim 2, wherein said first and said second tables each include a spring biased latch, and said spring biased latches of said first and said second tables are engageable with said two posts of said base respectively for anchoring said first and said second tables to said base at said first working position and at said second working position respectively.

4. The dumbbell and barbell supporting system as claimed in claim 3, wherein said base includes two ears mounted on said two posts respectively, and said two ears each include two orifices formed in said two ears for engaging with said spring biased latch.

5. The dumbbell and barbell supporting system as claimed in claim 1, wherein said first table includes two casings supported on said first table for engaging with and for supporting said first and said second weight members of said first dumbbell on said first table, and said second table includes two casings supported on said second table for engaging with and for supporting said first and said second weight elements of said second dumbbell on said second table.

6. The dumbbell and barbell supporting system as claimed in claim 1, wherein said first dumbbell includes two spring biased catches slidably engaged in said first handlebar and engageable with said first and said second weight members for coupling said first and said second weight members to said first handlebar.

7. The dumbbell and barbell supporting system as claimed in claim 1, wherein said second dumbbell includes two spring biased catches slidably engaged in said second handlebar and engageable with said first and said second weight elements for coupling said first and said second weight elements to said second handlebar.

8. The dumbbell and barbell supporting system as claimed in claim 1, wherein said longitudinal bar includes two spring biased locks for engaging with said first and said second weight members and said first and said second weight elements.

* * * * *